US008844677B1

(12) United States Patent
Young, II

(10) Patent No.: US 8,844,677 B1
(45) Date of Patent: Sep. 30, 2014

(54) EXPANDABLE AND COLLAPSIBLE PLATFORM SYSTEM

(76) Inventor: George Young, II, Falmouth, MA (US)

( * ) Notice: Subject to any disclaimer, the term of this patent is extended or adjusted under 35 U.S.C. 154(b) by 174 days.

(21) Appl. No.: 13/531,271

(22) Filed: Jun. 22, 2012

Related U.S. Application Data

(63) Continuation-in-part of application No. 12/541,047, filed on Aug. 13, 2009, now abandoned.

(51) Int. Cl.
*E04G 1/32* (2006.01)

(52) U.S. Cl.
USPC ..... 182/224; 182/116; 182/152

(58) Field of Classification Search
USPC ..... 182/224, 225, 129, 115, 116, 117, 119, 182/120, 228.1, 229
See application file for complete search history.

(56) References Cited

U.S. PATENT DOCUMENTS

| | | | | | |
|---|---|---|---|---|---|
| 1,725,168 | A | * | 8/1929 | Willis | 182/225 |
| 2,272,957 | A | * | 2/1942 | Walp | 182/224 |
| 2,398,604 | A | * | 4/1946 | Thorne | 182/225 |
| 2,418,862 | A | * | 4/1947 | Anderson | 182/25 |
| 2,966,957 | A | * | 1/1961 | Ireland | 182/224 |
| 3,388,771 | A | * | 6/1968 | Corneliusen | 182/153 |
| 4,102,555 | A | * | 7/1978 | Tobolski | 312/240 |
| 4,207,966 | A | * | 6/1980 | Aubin et al. | 182/186.4 |
| 4,241,808 | A | * | 12/1980 | Middleton et al. | 182/155 |
| 4,722,420 | A | * | 2/1988 | Arthurs et al. | 182/93 |
| 4,823,913 | A | * | 4/1989 | Riegel, Jr. | 182/225 |
| 4,941,547 | A | | 7/1990 | Livick | |
| D341,664 | S | | 11/1993 | Newkirk | |
| 5,368,127 | A | | 11/1994 | Phillips | |
| D388,882 | S | | 1/1998 | Kain | |
| 5,727,650 | A | * | 3/1998 | Thomas | 182/224 |
| 6,334,508 | B1 | | 1/2002 | Shields | |
| 6,712,182 | B1 | * | 3/2004 | Baker | 182/225 |
| 6,962,237 | B2 | | 11/2005 | Underhill | |
| 2006/0169535 | A1 | | 8/2006 | Phillips et al. | |

* cited by examiner

*Primary Examiner* — Daniel Cahn

(57) ABSTRACT

An expandable and collapsible platform system for providing a portable elevated platform for a user has a generally "A" shaped platform support member. A first vertical leg is attached to a second vertical leg via a top base and a plurality of fixed horizontal rungs. The fixed horizontal rungs incrementally increase in width from top to bottom. The first vertical leg has a first vertical leg extension and the second vertical leg has a second vertical leg extension. A horizontal beam has an engagement component for interfacing with a stationary vertical support surface with a hinge mounted to a top base. A planar flooring member is located on a top base top surface and a horizontal beam top surface.

3 Claims, 8 Drawing Sheets

EXPANDABLE AND COLLAPSIBLE PLATFORM SYSTEM

CROSS REFERENCE

This application claims priority to U.S. non-provisional application Ser. No. 12/541,047 filed Aug. 13, 2009 as a continuation-in-part, the specification of which is incorporated herein by reference in its entirety.

BACKGROUND OF THE INVENTION

Periodically when performing repairs or maintenance on a structure, it becomes necessary to have a work surface raised above the ground, for example when an individual is working on a wall or ceiling of a house or a building. The present invention features an expandable and collapsible platform system for providing a portable elevated platform for a user.

SUMMARY

The present invention features an expandable and collapsible platform system for providing a portable elevated platform for a user. In some embodiments, the system comprises a generally "A" shaped platform support member. In some embodiments, a first vertical leg is attached to a second vertical leg via a top base and a plurality of fixed horizontal rungs. In some embodiments, the top base is narrower than any of the fixed horizontal rungs. In some embodiments, the fixed horizontal rungs incrementally increase in width from top to bottom.

In some embodiments, the first vertical leg comprises a first vertical leg extension telescopically located on the first vertical leg second end and the second vertical leg comprises a second vertical leg extension telescopically located on the second vertical leg second end. In some embodiments, the adjustable horizontal rung comprises a telescopically adjustable length. In some embodiments, an adjustable rung first end is located on the first vertical leg extension and an adjustable rung second end is located on the second vertical leg extension.

In some embodiments, the top base comprises generally U-shaped cradle located on a top base interior side. In some embodiments, the pivoting horizontal beam comprises a horizontal beam first end having an engagement component for interfacing with a stationary vertical support surface. In some embodiments, a horizontal beam second end comprises a hinge for connecting it to the top base. In some embodiments, the horizontal beam comprises a brace pivotally located on a brace mount. In some embodiments, a brace first end is slidably inserted into a hollow recess located on a horizontal beam bottom surface as the pivoting horizontal beam is moved to a second position.

In some embodiments, the system comprises a planar flooring member located on the top base top surface and the horizontal beam top surface. In some embodiments, the system comprises a stationary vertical support surface.

In some embodiments, for operation the platform support member is set into position close to a stationary vertical support surface. In some embodiments, the pivoting horizontal beam is rotationally pivoted from a first position into a second position. In some embodiments, the pivoting horizontal beam is set into the cradle and affixed into position via a beam pin located through a beam aperture and a cradle aperture. In some embodiments, the first vertical leg extension is affixed into place via a first pin located through the first vertical leg aperture and one of a plurality of sequentially located first vertical leg extension apertures. In some embodiments, the second vertical leg extension is affixed into place via a second pin located through a second vertical leg aperture and one of a plurality of sequentially located second vertical leg extension apertures to result in a specific length of the platform support member. In some embodiments, the adjustable horizontal rungs are affixed into position.

In some embodiments, the platform support member is located against the stationary vertical support surface. In some embodiments, the engagement component interfaces with the stationary vertical support surface. In some embodiments, the flooring member is located on a horizontal beam top surface and the top base top surface. In some embodiments, the flooring member is for providing a portable elevated platform for a user.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
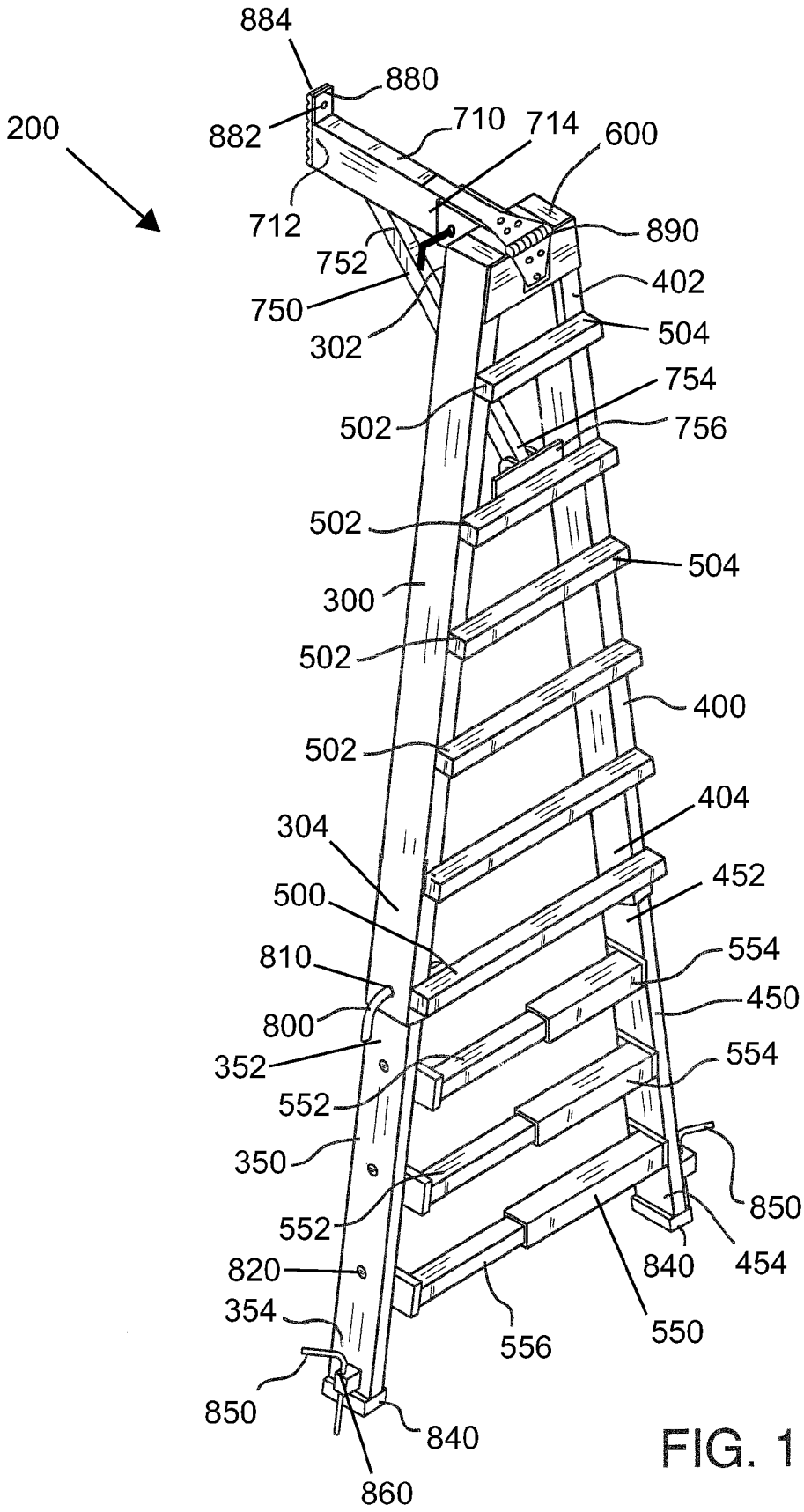
FIG. 1 is a perspective view of the platform support member of the present invention.

Following is a list of elements corresponding to a particular element referred to herein:

100 Expandable and collapsible platform system
200 Platform support member
300 First vertical leg
302 First vertical leg first end
304 First vertical leg second end
350 First vertical leg extension
352 First vertical leg extension first end
354 First vertical leg extension second end
400 Second vertical leg
402 Second vertical leg first end
404 Second vertical leg second end
450 Second vertical leg extension
452 Second vertical leg extension first end
454 Second vertical leg extension second end
500 Fixed horizontal rung
502 Fixed horizontal rung first end
504 Fixed horizontal rung second end
550 Adjustable horizontal rung
552 Adjustable horizontal rung first end
554 Adjustable horizontal rung second end

Figure 2:
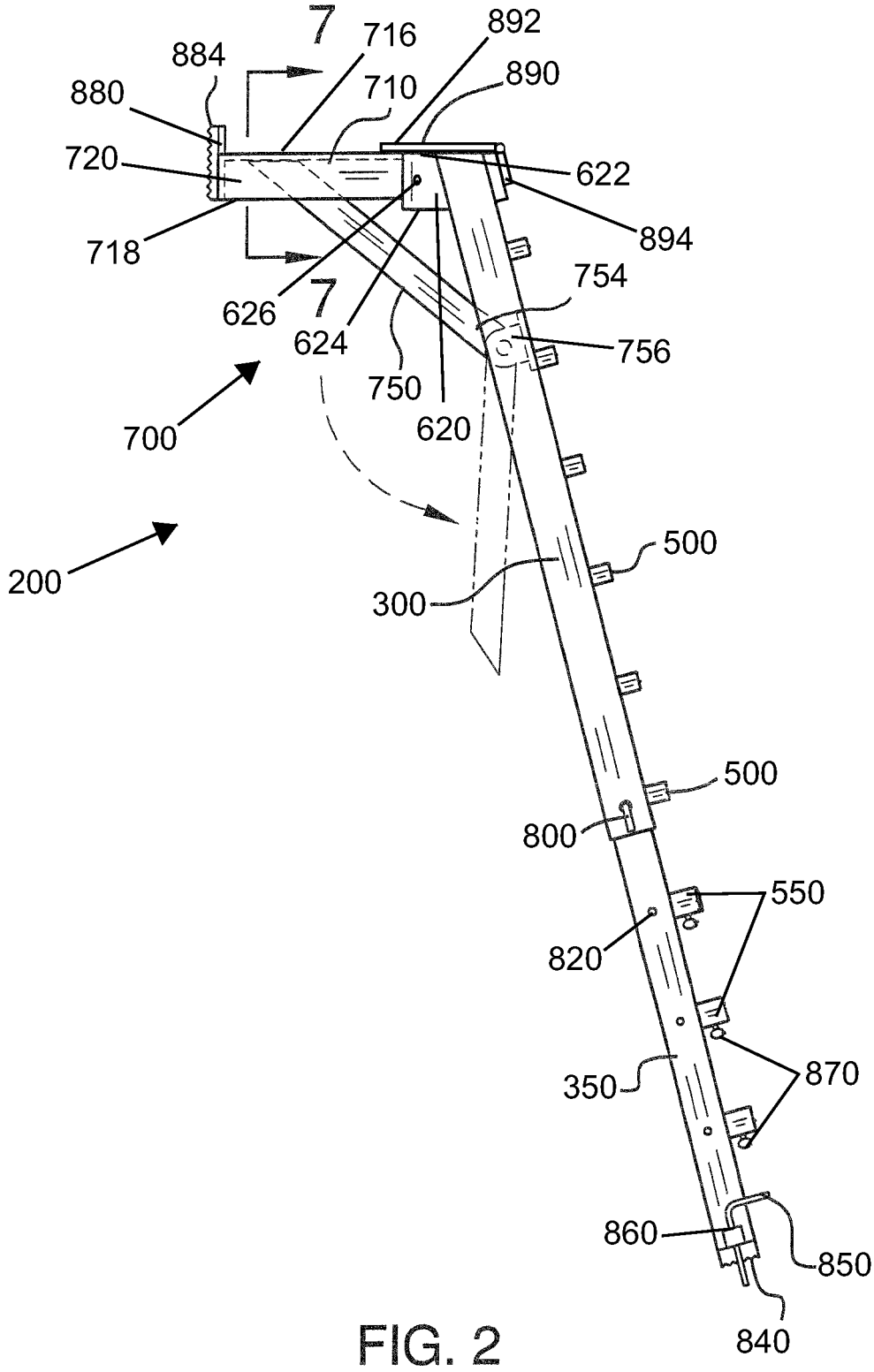
FIG. 2 is a side view of the platform support member of the present invention.
Figure 3:
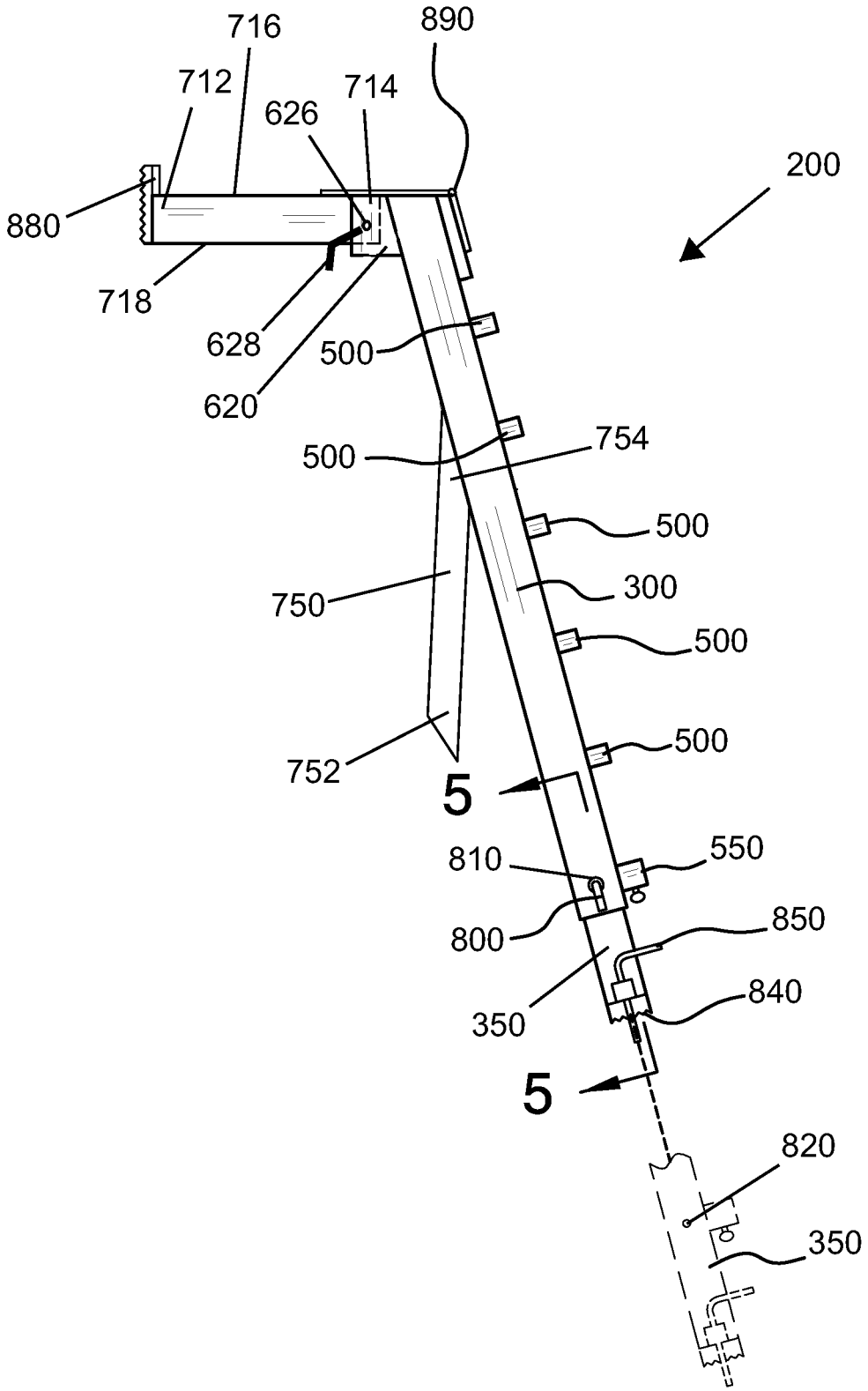
FIG. 3 is a side view of the platform support member of the present invention.
Figure 4:
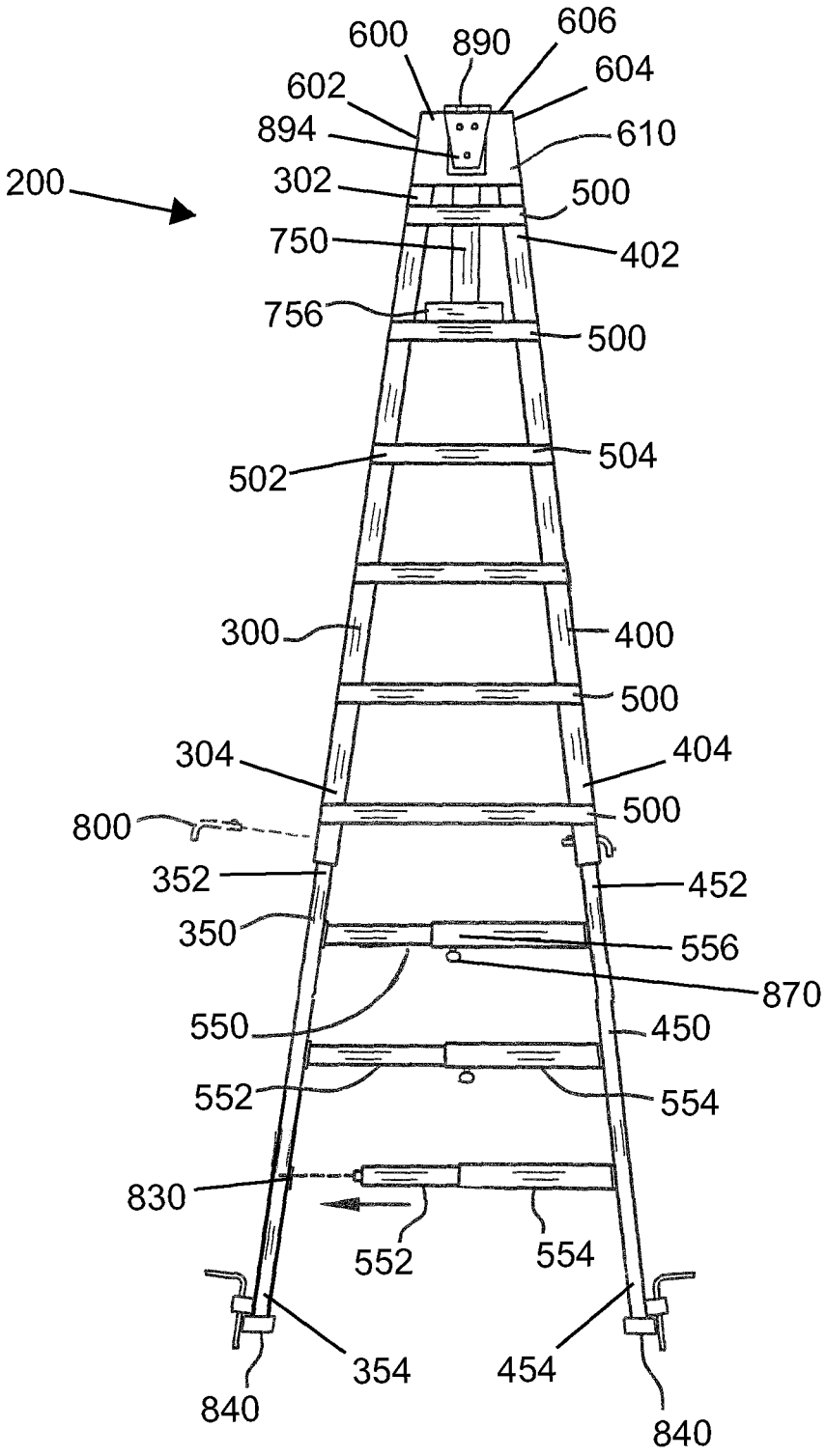
FIG. 4 is a front view of the platform support member of the present invention.
Figure 5:
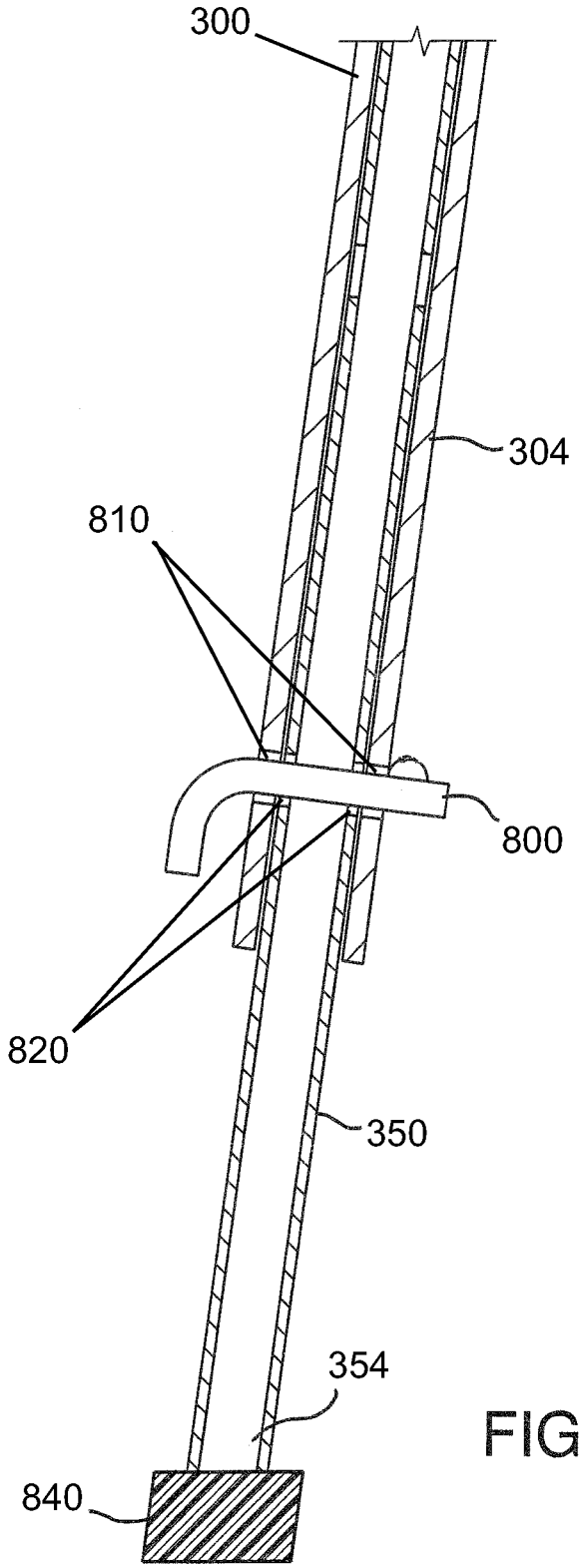
FIG. 5 is a cross-sectional view in a coronal plane of the vertical leg of the present invention.
Figure 6:
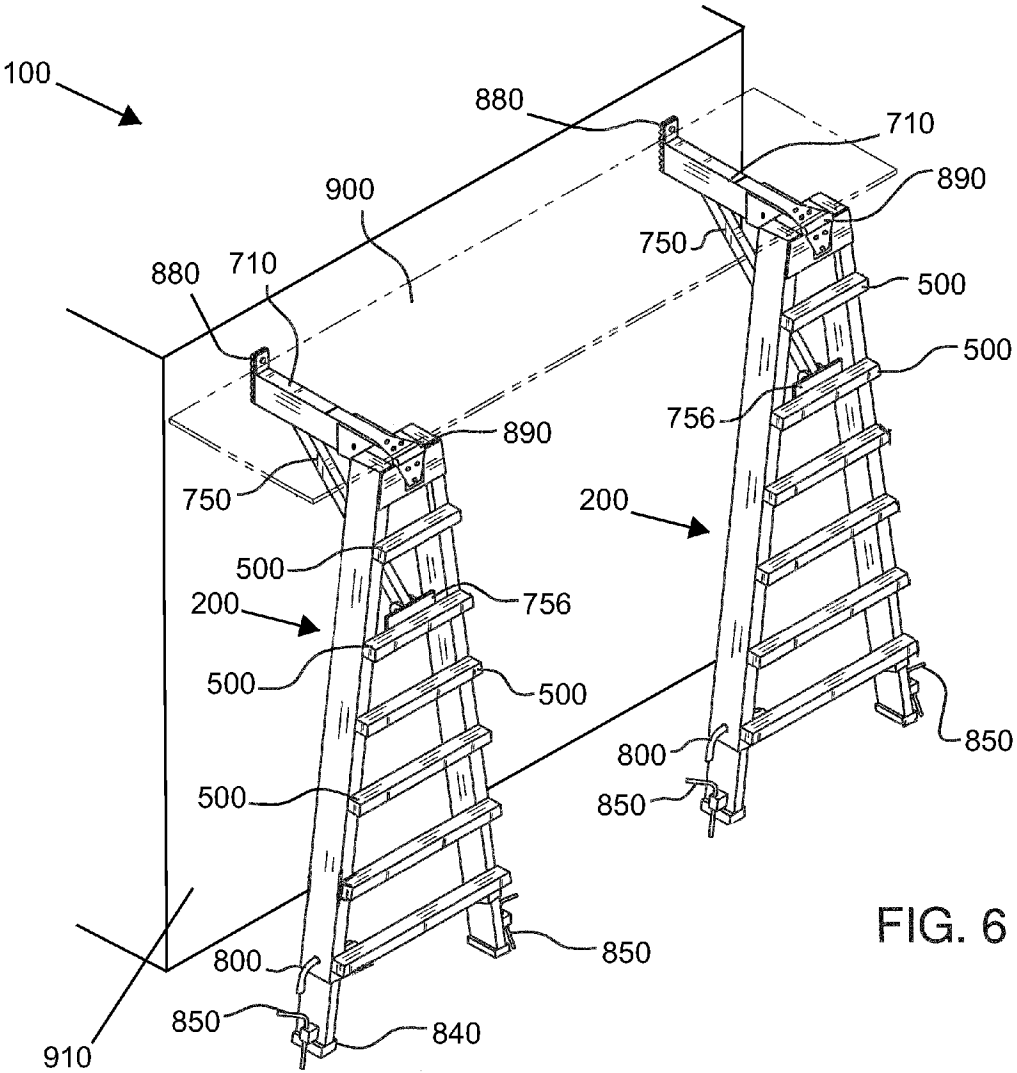
FIG. 6 is a perspective view of the present invention.
Figure 7:
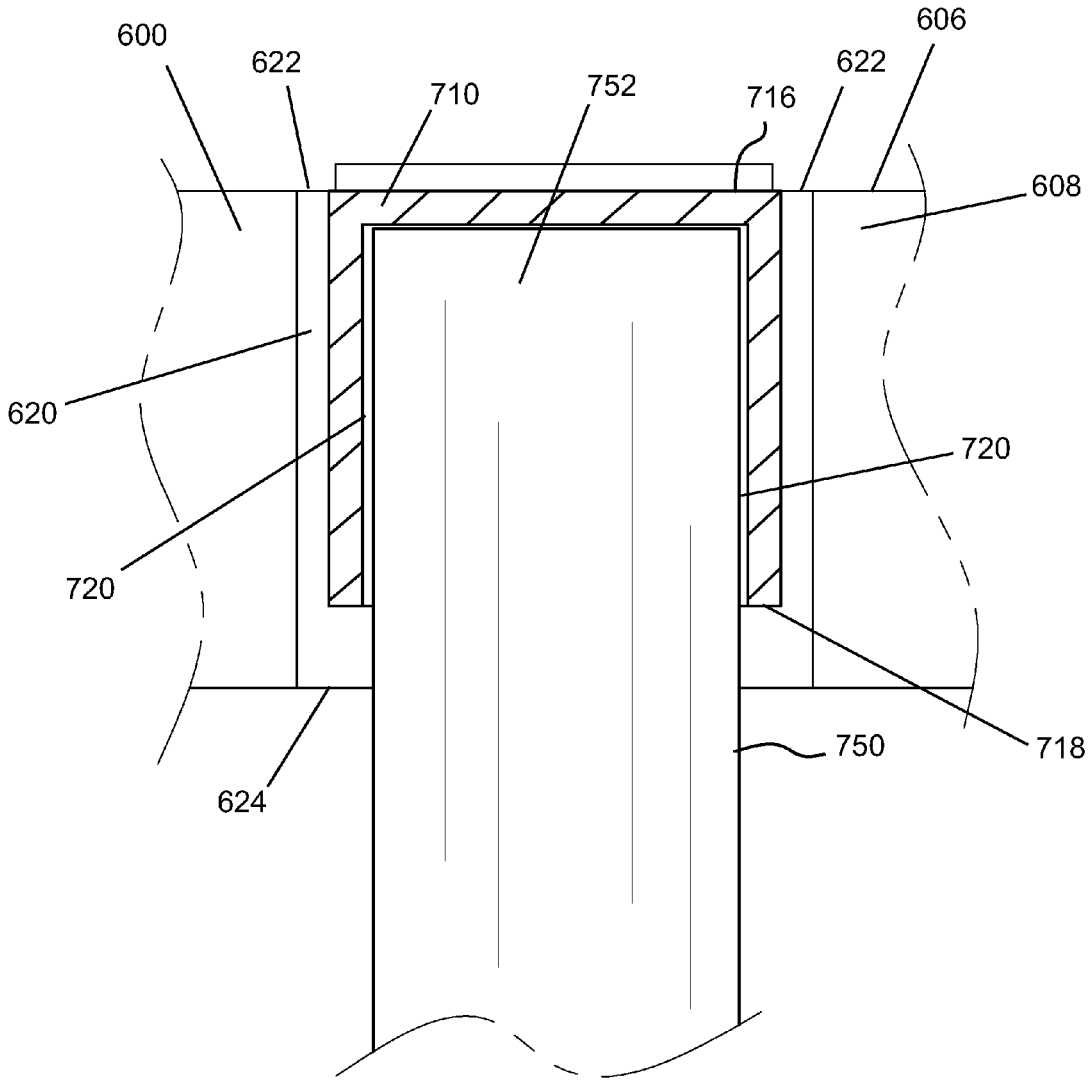
FIG. 7 is a cross-sectional view in a coronal plane of the horizontal beam of the present invention.
Figure 8:
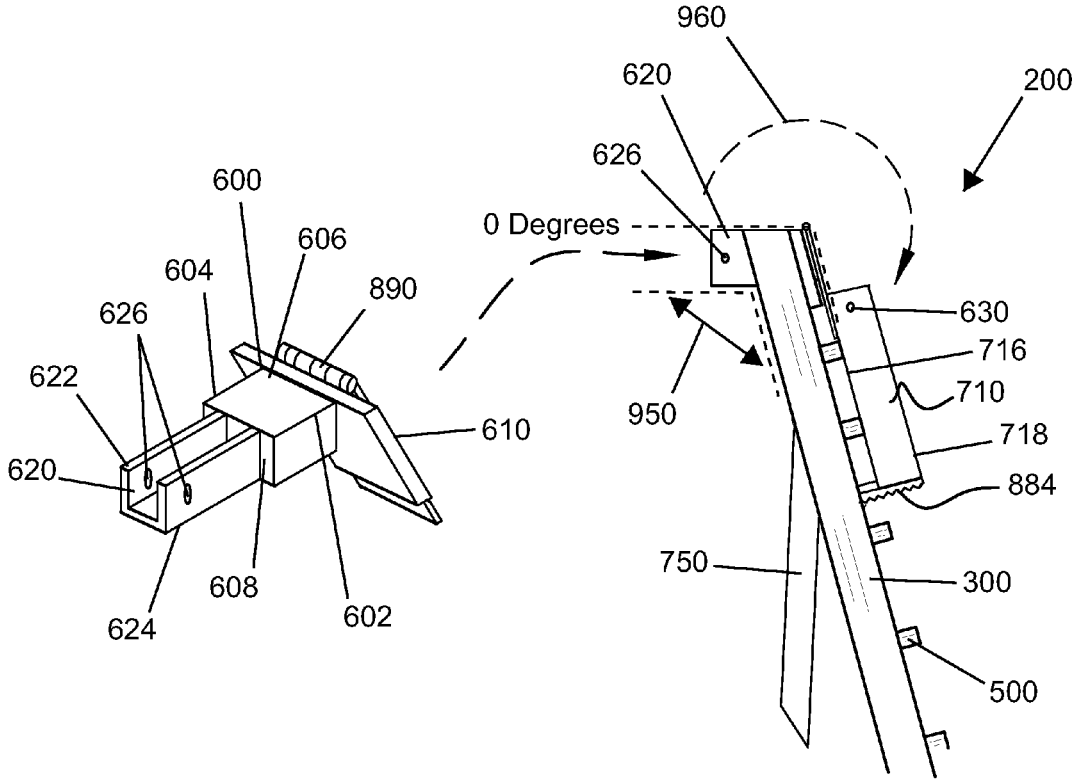
FIG. 8 is a perspective view the top base of the present invention.

556 Adjustable horizontal rung middle section
600 Top base
602 Top base first edge
604 Top base second edge
606 Top base top surface
608 Top base interior surface
610 Top base exterior surface
620 Cradle
622 Cradle top edge
624 Cradle bottom surface
626 Cradle aperture
628 Beam pin
630 Beam aperture
700 Horizontal beam assembly
710 Horizontal beam
712 Horizontal beam first end
714 Horizontal beam second end
716 Horizontal beam top surface
718 Horizontal beam bottom surface
720 Horizontal beam hollow recess
750 Brace
752 Brace first end
754 Brace second end
756 Brace mount
800 Vertical leg pin
810 Vertical leg aperture
820 Vertical leg extension aperture
830 Receiving attachment
840 Vertical leg gripping component
850 Stake
860 Vertical leg extension securing aperture
870 Set screw
880 Engagement component
882 Engagement aperture
884 Engagement gripping surface
890 Hinge
892 Hinge first end
894 Hinge second end
900 Planar flooring member
910 Stationary vertical support surface
950 Angle A
960 Arc B Referring now to FIG. 1-8, the present invention features an expandable and collapsible platform system (100) for providing a portable elevated platform for a user. In some embodiments, the system (100) comprises a generally "A" shaped platform support member (200) having a first vertical leg (300), a second vertical leg (400), a plurality of fixed horizontal rungs (500), a telescopic first vertical leg extension (350), a telescopic second vertical leg extension (450), a plurality of telescopically adjustable horizontal rungs (550), a top base (600), and a pivoting horizontal beam assembly (700) having a brace (750) pivotally located beneath a pivoting horizontal beam (710). In some embodiments, the first vertical leg (300) comprises a first vertical leg first end (302) and a first vertical leg second end (304). In some embodiments, the second vertical leg (400) comprises a second vertical leg first end (402) and a second vertical leg second end (404).

In some embodiments, the fixed horizontal rung (500) comprises a fixed horizontal rung first end (502) and a fixed horizontal rung second end (504). In some embodiments, the fixed horizontal rung first end (502) is securely located on the first vertical leg (300). In some embodiments, the fixed horizontal rung second end (504) is securely located on the second vertical leg (400). In some embodiments, a plurality of fixed horizontal rungs (500) is incrementally located in a series on the first vertical leg (300) from the first vertical leg first end (302) to the first vertical leg second end (304) and the second vertical leg (400) from the second vertical leg first end (402) to the second vertical leg second end (404). In some embodiments, the fixed horizontal rungs (500) are incrementally spaced. In some embodiments, the fixed horizontal rungs (500) are located generally perpendicular to the first vertical leg (300) and the second vertical leg (400). In some embodiments, the first vertical leg (300) is attached to the second vertical leg (400) via the top base (600) and the plurality of fixed horizontal rungs (500). In some embodiments, the first vertical leg first end (302) is located on a top base first edge (602). In some embodiments, the second vertical leg first end (402) is located on a top base second edge (604). In some embodiments, the top base (600) comprises a width from the top base first edge (602) to the top base second edge (604) narrower than the narrowest fixed horizontal rung (500). In some embodiments, the plurality of fixed horizontal rungs (500) incrementally increase in width from the first vertical leg first end (302) and the second vertical leg first end (402) to the first vertical leg second end (304) and the second vertical leg second end (404) thereby affixing a first width between the first vertical leg first end (302) and the second vertical leg first end (402) to be narrower than a second width between the first vertical leg second end (304) and the second vertical leg second end (404).

In some embodiments, the first vertical leg (300) comprises the first vertical leg extension (350) telescopically located on and extending from the first vertical leg second end (304). In some embodiments, the second vertical leg (400) comprises the second vertical leg extension (450) telescopically located on and extending from the second vertical leg second end (404). In some embodiments, the first vertical leg extension (350) is affixed into a position via a first vertical leg pin (800) located through both a first vertical leg aperture (810) and one of a plurality of sequentially located first vertical leg extension apertures (820). In some embodiments, the second vertical leg extension (450) is affixed into a position via a second vertical leg pin (800) located through both a second vertical leg aperture (810) and one of a plurality of sequentially located second vertical leg extension apertures (820). In some embodiments, the first vertical leg extension (350) comprises a plurality of sequentially located receiving attachments (830) for attaching an adjustable horizontal rung first end (552). In some embodiments, the second vertical leg extension (450) comprises a plurality of sequentially located receiving attachments (830) for attaching an adjustable horizontal rung second end (554). In some embodiments, the first vertical leg extension (350) comprises a first vertical leg gripping component (840) located on a first vertical leg extension second end (354). In some embodiments, the first vertical leg extension (350) comprises a first vertical leg extension securing aperture (860) located on the first vertical leg extension second end (354) for receiving a first stake (850). In some embodiments, the second vertical leg extension (450) comprises a gripping component located on a second vertical leg extension second end (454). In some embodiments, the second vertical leg extension (450) comprises a second vertical leg extension securing aperture (860) located on the second vertical leg extension second end (454) for receiving a second stake (850). In some embodiments, the stake (850) is for inserting through the leg extension securing aperture (860) into a ground surface for securing the first vertical leg extension (350) or the second vertical leg extension (450) so equipped.

In some embodiments, the adjustable horizontal rung (550) comprises an adjustable horizontal rung first end (552) and an adjustable horizontal rung second end (554). In some embodiments, the adjustable horizontal rung (550) comprises a telescopically adjustable length. In some embodiments, the length is affixed via a set screw (870) located in an adjustable horizontal rung middle section (556). In some embodiments, the adjustable horizontal rung first end (552) is attachably and detachably located on the first vertical leg extension (350) via the receiving attachment (830). In some embodiments, the adjustable horizontal rung second end (554) is attachably and detachably located on the second vertical leg extension (450) via the receiving attachment (830). In some embodiments, the receiving attachment (830) comprises external threads. In some embodiments, the receiving attachment (830) comprises internal threads. In some embodiments, the receiving attachment (830) comprises a collar. In some embodiments, the receiving attachment (830) comprises a set screw. In some embodiments, the receiving attachment (830) comprises an aperture. In some embodiments, the receiving attachment (830) comprises a projection. In some embodiments, the adjustable horizontal rung first end (552) and the adjustable horizontal rung second end (554) comprise internal threads for attaching to the receiving attachment (830). In some embodiments, the adjustable horizontal rung first end (552) and the adjustable horizontal rung second end (554) comprise external threads for attaching to the receiving attachment (830). In some embodiments, the adjustable horizontal rung first end (552) and the adjustable horizontal rung second end (554) comprise a projection for attaching to the receiving attachment (830). In some embodiments, the adjustable horizontal rung first end (552) and the adjustable horizontal rung second end (554) comprise a collar for attaching to the receiving attachment (830).

In some embodiments, a plurality of receiving attachments (830) are incrementally located in series on the first vertical leg extension (350) from a first vertical leg extension first end (352) to the first vertical leg extension second end (354) and the second vertical leg extension (450) from a second vertical leg extension first end (452) to the second vertical leg extension second end (454). In some embodiments, upon installation the adjustable horizontal rungs (550) are incrementally spaced. In some embodiments, the adjustable horizontal rungs (550) are located generally perpendicular to the first vertical leg extension (350) and the second vertical leg extension (450) via the receiving attachments (830).

In some embodiments, the top base (600) comprises a top base top surface (606), a top base interior surface (608), a top base exterior surface (610), the top base first edge (602), and the top base second edge (604). In some embodiments, a generally U-shaped cradle (620) is located on the top base interior surface (608). In some embodiments, a cradle bottom surface (624) is located at an angle, angle A (950), with respect to the top base interior surface (608). In some embodiments, angle A (950) is from about 90 degrees to about 180 degrees. In some embodiments, angle A (950) is adjustable. In some embodiments, the cradle (620) longitudinally projects out and away from the top base interior surface (608). In some embodiments, a cradle top edge (622) is generally flush with the top base top surface (606).

In some embodiments, the horizontal beam assembly (700) comprises a pivoting horizontal beam (710) having a horizontal beam first end (712), a horizontal beam second end (714), a horizontal beam top surface (716), and a horizontal beam hollow recess (720) located on a horizontal beam bottom surface (718). In some embodiments, the horizontal beam first end (712) comprises an engagement component (880) having an engagement aperture (882) and an engagement gripping surface (884) for interfacing with a stationary vertical support surface (910). In some embodiments, the horizontal beam second end (714) comprises a hinge (890) having a hinge first end (892) located thereon with a hinge second end (894) located on the top base exterior surface (610). In some embodiments, the hinge (890) pivotally rotates in an arc, arc B (960) from about 0 degrees to about 270 degrees. In some embodiments, for storage the pivoting horizontal beam (710) is located in a first position. In some embodiments, in the first position the horizontal beam top surface (716) rests against the fixed horizontal rungs (500). In some embodiments, for operation, the pivoting horizontal beam (710) is located in a second position. In some embodiments, for operation the beam is pivotally rotated about the hinge (890) to the second position. In some embodiments, in the second position, the horizontal beam bottom surface (718) rests in the cradle (620). In some embodiments, in the second position the horizontal beam second end (714) interfaces with and rests against or proximal to the top base interior surface (608). In some embodiments, in a second position the horizontal beam (710) is affixed into position via a beam pin (628) located through both a beam aperture (630) and a cradle aperture (626).

In some embodiments, the horizontal beam assembly (700) further comprises a brace (750) having a brace first end (752) and a brace second end (754). In some embodiments, the brace second end (754) is pivotally located on a brace mount (756). In some embodiments, the brace mount (756) is located on either the first vertical leg (300) and the second vertical leg (400) or the fixed horizontal rung (500). In some embodiments, for use, the brace (750) is pivoted into position. In some embodiments, the brace first end (752) is slidably and lockably inserted into the horizontal beam hollow recess (720) located on the horizontal beam bottom surface (718) as the horizontal beam (710) is moved to the second position. In some embodiments, the brace (750) is for supporting the pivoting horizontal beam (710). In some embodiments the brace (750) is held into position by the horizontal beam (710) via the horizontal beam hollow cavity (720).

In some embodiments, the system (100) comprises a planar flooring member (900) located on the top base top surface (606) and the horizontal beam top surface (716). In some embodiments, the system (100) comprises a stationary vertical support surface (910), for example a wall of a house or other building.

In some embodiments, for operation the platform support member (200) is set into position close to a stationary vertical support surface (910). In some embodiments, the pivoting horizontal beam (710) is rotationally pivoted from a first position into a second position. In some embodiments, the pivoting horizontal beam (710) is set into the cradle (620) and affixed into position via the beam pin (628) located through both the beam aperture (630) and the cradle aperture (626). In some embodiments, the horizontal beam (710) harnesses the downward force from a user's weight when using the system (100). In some embodiments, the force from the user's weight is applied in the same direction as the force used to move the horizontal beam (710) into the second position. In some embodiments, the downward force from the user's weight securely holds the horizontal beam (710) into position. In some embodiments, the downward force from the user's weight securely holds the horizontal beam (710) into an engaged position with the brace (750). In some embodiments, the first vertical leg extension (350) is affixed into place via the first vertical leg pin (800) located through both the first vertical leg aperture (810) and one of the plurality of sequentially located first vertical leg extension apertures (820). In some embodiments, the second vertical leg extension is affixed into place via the second vertical leg pin (800) located through both the second vertical leg aperture (810) and one of the plurality of sequentially located second vertical leg extension apertures (820) resulting in a specific length of the platform support member (200). In some embodiments, the adjustable horizontal rungs (550) are affixed into position via the set screw (870) located in the adjustable horizontal rung middle section (556).

In some embodiments, the platform support member (200) is located against the stationary vertical support surface (910). In some embodiments, the engagement component (880) frictionally interfaces with the stationary vertical support surface (910). In some embodiments, the planar flooring member (900) is located on a horizontal beam top surface (716) and the top base top surface (606). In some embodiments, the planar flooring member (900) is for providing a portable elevated platform for a user.

In some embodiments, the top base (600) comprises a width from the top base first edge (602) to the top base second edge (604) at least equal to one half of a length of the pivoting horizontal beam (710) for providing a stable structure for supporting the planar flooring member (900).

In some embodiments, a plurality of platform support members (200) is used. In some embodiments, one or more planar flooring members (900) are located on the plurality of platform support members (200).

As used herein, the term "about" refers to plus or minus 10% of the referenced number. For example, an embodiment wherein the top base is about 10 inches in length includes a top base that is between 9 and 11 inches in length.

The disclosures of the following U.S. Patents are incorporated in their entirety by reference herein: U.S. Pat. No. 6,962,237; U.S. Pat. No. 6,712,182; U.S. Pat. No. 6,334,508; U.S. Pat. No. 5,368,127; U.S. Pat. No. 4,941,547; U.S. Pat. No. 2,966,957; U.S. Pat. Pub. No. 2006/0169535.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. An expandable and collapsible platform system (100) for providing a portable elevated platform for a user, wherein said system (100) comprises:

(a) a generally "A" shaped platform support member (200) having a first vertical leg (300), a second vertical leg (400), a plurality of fixed horizontal rungs (500), a telescopic first vertical leg extension (350), a telescopic second vertical leg extension (450), a plurality of telescopically adjustable horizontal rungs (550), a top base (600), and a pivoting horizontal beam assembly (700) having a brace (750) pivotally disposed beneath a pivoting horizontal beam (710), wherein the first vertical leg (300) comprises a first vertical leg first end (302) and a first vertical leg second end (304), wherein the second vertical leg (400) comprises a second vertical leg first end and a second vertical leg second end (404), horizontal rungs (500) comprises a fixed horizontal rung first end (502) and a fixed horizontal rung second end (504), wherein each of the fixed horizontal rung first ends (502) is respectively affixedly disposed on the first vertical leg (300), wherein each of the fixed horizontal rung second ends (504) is respectively affixedly disposed on the second vertical leg (400), wherein each of the plurality of fixed horizontal rungs (500) is incrementally disposed in a series on the first vertical leg (300) and the second vertical leg (400) extending from the vertical leg first ends to the vertical leg second ends (404), wherein the fixed horizontal rungs (500) are incrementally spaced, wherein the fixed horizontal rungs (500) are disposed generally perpendicular to the first vertical leg (300) and the second vertical leg (400), wherein the first vertical leg (300) is attached to the second vertical leg (400) via the top base (600) and via the plurality of fixed horizontal rungs (500), wherein the first vertical leg first end (302) is disposed on a top base first edge of the top base (602), wherein the second vertical leg first end (402) is disposed on a top base second edge of the top base (604), wherein the top base (600) comprises a top base width extending from the top base first edge (602) to the top base second edge (604), the top base width is shorter than a width of a shortest fixed horizontal rung of the plurality of fixed horizontal rungs, wherein each of the plurality of fixed horizontal rungs (500) incrementally increases in width with respect to each other incrementing from the vertical leg first ends to the vertical leg second ends thereby forming a first width extending between the first vertical leg first end (302) and the second vertical leg first end (402) that is shorter than a second width extending between the first vertical leg second end (304) and the second vertical leg second end (404), wherein the widths are parallel and extend in a direction extending from the first vertical leg to the second vertical leg, wherein the first vertical leg (300) has the first vertical leg extension (350) telescopically disposed in and extending from the first vertical leg second end (304), wherein the second vertical leg (400) has the second vertical leg extension (450) telescopically disposed in and extending from the second vertical leg second end (404), wherein the first vertical leg extension (350) is affixed into a position via a first vertical leg pin (800) disposed through both a first vertical leg aperture (810) and one of a plurality of sequentially disposed first vertical leg extension apertures (820), wherein the second vertical leg extension (450) is affixed into a position via a second vertical leg pin (800) disposed through both a second vertical leg aperture (810) and one of a plurality of sequentially disposed second vertical leg extension apertures (820), wherein the first vertical leg extension (350) comprises a first plurality of sequentially disposed receiving attachments (830), wherein the second vertical leg extension (450) comprises a second plurality of sequentially disposed receiving attachments (830), wherein the first vertical leg extension (350) comprises a first vertical leg gripping component (840) disposed on a first vertical leg extension second end (354), wherein the first vertical leg extension (350) comprises a first vertical leg extension securing aperture (860) disposed on the first vertical leg extension second end (354) for receiving a first stake (850), wherein the second vertical leg extension (450) comprises a second vertical leg gripping component (840) disposed on a second vertical leg extension second end (454), wherein the second vertical leg extension (450) comprises a second vertical leg extension securing aperture (860) disposed on the second vertical leg extension second end (454) for receiving a second stake (850), wherein each respective adjustable horizontal rung of the plurality of adjustable horizontal rungs (550) comprises an adjustable horizontal rung first end (552) and an adjustable horizontal rung second end (554), wherein each of the adjustable horizontal rungs (550) respectively comprises a telescopically adjustable length that is affixed via a set screw (870) disposed in a middle section (556), wherein each of the adjustable horizontal rung first ends (552) is respectively attachably and detachably disposed on the first vertical leg extension (350) via the first receiving attachments (830), wherein each of the adjustable horizontal rung second ends (554) is respectively attachably and detachably disposed on the second vertical leg extension (450) via the second receiving attachments (830), wherein the first plurality of receiving attachments (830) are incrementally disposed in series on the first vertical leg extension (350) from a first vertical leg extension first end (352) to the first vertical leg extension second end (354) and the second plurality of receiving attachments (830) are incrementally disposed in series on the second vertical leg extension (450) from a second vertical leg extension first end (452) to the second vertical leg extension second end (454), wherein the adjustable horizontal rungs (550) connect and extend from the first vertical leg extension (350) via the first receiving attachments (830) to the second vertical leg extension (450) via the second receiving attachments (830), wherein the top base (600) comprises a top base top surface (606), a top base interior surface (608), a top base exterior surface (610), the top base first edge (602), and the top base second edge (604), wherein a generally U-shaped cradle (620) is disposed on the top base interior surface (608), wherein a cradle bottom surface (624) is disposed at a first angle (950) with respect to the top base interior surface (608), wherein the first angle (950) is one angle within a range of 90 degrees to 180 degrees, wherein the cradle (620) longitudinally projects out and away from the top base interior surface (608), wherein a cradle top edge (622) is generally flush with the top base top surface (606), wherein the horizontal beam assembly (700) comprises the pivoting horizontal beam (710) having a horizontal beam first end (712), a horizontal beam second end (714), a horizontal beam top surface (716), and a horizontal beam hollow recess (720) extending between two horizontal beam bottom surfaces (718) and the horizontal beam top surface, wherein the horizontal beam first end (712) comprises an engagement component (880) having an engagement aperture (882) and an engagement gripping surface (884) for interfacing with a stationary vertical support surface (910), wherein the horizontal beam second end (714) comprises a hinge (890) having a hinge first end (892) disposed on the horizontal beam second end and a hinge second end (894) disposed on the top base exterior surface (610), wherein the hinge (890) can pivotally rotate in an arc between 0 degrees to 270 degrees, wherein for storage the pivoting horizontal beam (710) is disposed in a first position, wherein in the first position the horizontal beam top surface (716) rests against the fixed horizontal rungs (500), wherein for operation, the pivoting horizontal beam (710) is disposed in a second position, wherein for operation the beam is pivotally rotated about the hinge (890) via the arc to the second position, wherein in the second position, the horizontal beam bottom surface (718) rests in the cradle (620), wherein in the second position the horizontal beam second end (714) interfaces with and rests against the top base interior surface (608), wherein in the second position the horizontal beam (710) is affixed into position via a beam pin (628) disposed through both of a beam aperture (630) and a cradle aperture (626), the horizontal beam assembly (700) further comprises the brace (750) having a brace first end (752) and a brace second end (754), wherein the brace second end (754) is pivotally disposed on a brace mount (756), wherein the brace mount (756) is disposed on the vertical legs or at least one of the fixed horizontal rungs (500), wherein for use, the brace (750) can be pivoted into position wherein the brace first end (752) is slidably and lockably inserted into the horizontal beam hollow recess (720), wherein the brace (750) is for supporting the pivoting horizontal beam (710); and (b) a planar flooring member (900) disposed on the top base top surface (606) and the horizontal beam top surface (716); and (c) the stationary vertical support surface (910);

wherein for operation:

the platform support member (200) can be set into position proximal to the stationary vertical support surface (910), the pivoting horizontal beam (710) can be rotationally pivoted through 270 degrees of motion from the first position into the second position, the pivoting horizontal beam can be set into the cradle (620) and affixed into position via the beam pin (628) disposed through both of the beam aperture (630) and the cradle aperture (626), the system can have a downward force from a user's weight securely hold the horizontal beam into position, the first vertical leg extension (350) can be affixed into place via the first vertical leg pin (800) disposed through both of the first vertical leg aperture (810) and one of the plurality of sequentially disposed first vertical leg extension apertures (820), the second vertical leg extension can be affixed into place via the second vertical leg pin (800) disposed through both of the second vertical leg aperture (810) and one of the plurality of sequentially disposed second vertical leg extension apertures (820) thereby resulting in a selected height of the platform support member (200), each of the adjustable horizontal rungs (550) can be affixed into position via each of the set screws (870) disposed in each of the middle sections of the adjustable horizontal rungs (556) respectively, the platform support member (200) can be disposed against the stationary vertical support surface (910) so that the engagement component (880) interfaces with the stationary vertical support surface (910) while the planar flooring member (900) is disposed on the horizontal beam top surface (716) and the top base top surface (606) for providing a user with a portable elevated platform.

2. The system (100) of claim 1, wherein the top base width is equal to or longer than one half of a major length of the pivoting horizontal beam (710) in order to provide stability in supporting the planar flooring member (900).

3. The system (100) of claim 1, wherein
the system is capable of having a plurality of the platform support member (200) and capable of having a plurality of the planar flooring member (900).

* * * * *